US011524752B2

(12) United States Patent
Miller

(10) Patent No.: US 11,524,752 B2
(45) **Date of Patent: *Dec. 13, 2022**

(54) MOUNTING ASSEMBLY FOR WATERCRAFT

(71) Applicant: Michael Dee Miller, Russell's Point, OH (US)

(72) Inventor: Michael Dee Miller, Russell's Point, OH (US)

( * ) Notice: Subject to any disclaimer, the term of this patent is extended or adjusted under 35 U.S.C. 154(b) by 206 days.

This patent is subject to a terminal disclaimer.

(21) Appl. No.: 17/081,294

(22) Filed: Oct. 27, 2020

(65) Prior Publication Data

US 2021/0039754 A1 Feb. 11, 2021

Related U.S. Application Data

(63) Continuation of application No. 16/398,325, filed on Apr. 30, 2019, now Pat. No. 10,894,586.

(60) Provisional application No. 62/666,217, filed on May 3, 2018.

(51) Int. Cl.

| | |
|---|---|
| ***B63B 35/38*** | (2006.01) |
| ***B63B 35/613*** | (2006.01) |
| ***B63B 5/24*** | (2006.01) |
| ***B63B 73/40*** | (2020.01) |
| ***B63B 73/00*** | (2020.01) |

(52) U.S. Cl.

CPC ..... *B63B 35/613* (2013.01); *B63B 5/24* (2013.01); *B63B 35/38* (2013.01); *B63B 73/00* (2020.01); *B63B 73/40* (2020.01)

(58) Field of Classification Search

CPC ..... B63B 35/613; B63B 73/40; B63B 73/00; B63B 35/38; B63B 5/24

See application file for complete search history.

(56) References Cited

U.S. PATENT DOCUMENTS

| | | | | |
|---|---|---|---|---|
| 3,370,309 A * | 2/1968 | Fredelake | ..... | B60F 3/0092 114/344 |
| 3,877,094 A * | 4/1975 | Kelley | ..... | B60F 3/0092 114/61.15 |
| 4,295,236 A * | 10/1981 | Upchurch | ..... | B63B 1/121 114/61.24 |
| 4,562,786 A * | 1/1986 | Pruonto | ..... | B63B 1/121 114/361 |

(Continued)

OTHER PUBLICATIONS

Harris Boats. (2016). Pontoon boat center tube options: Choosing a Harris pontoon performance package. Retrieve Jun. 19, 2020 from: https://www.harrisboats.com/tips-tricks-news/center-tube-options-choosing-a-harris-pontoon-performance-package.html.

(Continued)

*Primary Examiner* — S. Joseph Morano
*Assistant Examiner* — Jovon E Hayes
(74) *Attorney, Agent, or Firm* — Carlson, Gaskey & Olds, P.C.

(57) ABSTRACT

An assembly for a watercraft according to an example of the present disclosure includes, among other things, a flotation device including an elongated slot and a mount that has first and second flanges extending outwardly from a bracket body. The first flange is configured to be mechanically attached to a frame, and the second flange is slideably received in the slot to secure the flotation device. A method of assembly for a watercraft is also disclosed.

21 Claims, 8 Drawing Sheets

(56) References Cited

U.S. PATENT DOCUMENTS

| | | | | |
|---|---|---|---|---|
| 4,998,497 | A * | 3/1991 | Nelson | B63B 21/00 114/230.19 |
| 5,184,561 | A | 2/1993 | Nickell, Jr. | |
| 5,435,260 | A | 7/1995 | Granie et al. | |
| 5,522,333 | A | 6/1996 | Lang et al. | |
| 5,540,169 | A | 7/1996 | David et al. | |
| 5,692,450 | A * | 12/1997 | Alter | B63B 34/05 114/61.15 |
| 5,784,977 | A | 7/1998 | Schell et al. | |
| 6,067,925 | A * | 5/2000 | Little | B63B 7/02 114/354 |
| 6,482,056 | B1 * | 11/2002 | Schell-Tomczak | B63H 20/06 248/641 |
| 6,708,642 | B1 | 3/2004 | Taylor | |
| 6,755,142 | B2 | 6/2004 | Rice | |
| 6,786,165 | B2 | 9/2004 | Trepanier | |
| 7,240,634 | B1 * | 7/2007 | Hoge, Jr. | B63B 7/082 114/61.1 |
| 7,870,830 | B2 | 1/2011 | Bogard et al. | |
| 7,950,340 | B1 | 5/2011 | Curtis | |
| 7,987,803 | B2 | 8/2011 | Cochran | |
| 8,186,291 | B1 | 5/2012 | Curtis | |
| 9,156,526 | B2 * | 10/2015 | Handley | B63B 35/34 |
| 9,233,732 | B2 * | 1/2016 | Wilson | B63B 35/34 |
| 9,376,166 | B2 | 6/2016 | Raiter et al. | |
| 9,475,548 | B1 | 10/2016 | Slocum | |
| 10,556,643 | B2 | 2/2020 | Carlisle | |
| 10,589,823 | B1 * | 3/2020 | Fenech | B63B 1/125 |
| 2009/0031939 | A1 | 2/2009 | Fishburn | |
| 2009/0301376 | A1 | 12/2009 | Hoover et al. | |
| 2012/0061893 | A1 * | 3/2012 | Hochberg | B60G 13/14 267/195 |
| 2015/0210357 | A1 | 7/2015 | Raiter et al. | |
| 2018/0099726 | A1 * | 4/2018 | Broadway | B63B 35/34 |
| 2018/0312230 | A1 | 11/2018 | Zolotuhin | |
| 2019/0337597 | A1 * | 11/2019 | Miller | B63B 5/24 |
| 2020/0115011 | A1 | 4/2020 | Sporing | |

OTHER PUBLICATIONS

Manitou. Sport handling package (SHP): Manitou pontoon boats. Retrieved Jun. 19, 2020 from: https://www.manitoupontoonboats.com/performance/shp/.

Serio, T. (2017). The hull story. Boating World Magazine. Retrieved Jun. 19, 2020 from https://www.boatingworld.com/feature-stories/the-hull-story/.

Roberts, B. Toon'ed into your future. Power Boating Canada. Retrieved Jun. 19, 2020 from: https://powerboating.com/tooned-into-your-future/.

Product Brochure. 24-inch diameter modular plastic pontoons. Wilson Pontoons, Inc.

Wilson Pontoons, Inc. 24-inch diameter modular plastic pontoons. Retrieved Jun. 19, 2020 from: https://plasticpontoon.com/24-inch-diameter-pontoons/.

Wilson Pontoons, Inc. Our Products. Retrieved Jun. 19, 2020 from: https://plasticpontoon.com/products/.

* cited by examiner

MOUNTING ASSEMBLY FOR WATERCRAFT

CROSS-REFERENCE TO RELATED APPLICATION won This application is a continuation of U.S. patent application Ser. No. 16/398,325, filed on Apr. 30, 2019, which claims priority to U.S. Provisional Application No. 62/666,217, filed May 3, 2018, herein incorporated by reference in its entirety.

BACKGROUND

This disclosure relates to vehicles such as watercraft, including mounting of flotation devices.

Watercraft can include flotation devices or pontoons mounted to a frame. Various techniques can be utilized for mounting the pontoons to the frame, such as welding or one more fasteners.

SUMMARY

An assembly for a watercraft according to an example of the present disclosure includes a flotation device defining an elongated slot extending between opposed ends of the flotation device, and an elongated mount that has first and second flanges extending outwardly from a bracket body. The first flange is configured to be mechanically attached to a frame, and the second flange is slideably received in the elongated slot to secure the flotation device.

In a further embodiment of any of the foregoing embodiments, the first and second flanges extending outwardly from the bracket body such that the mount has a generally S-shaped geometry.

In a further embodiment of any of the foregoing embodiments, the first and second flanges are vertically spaced apart and extend substantially parallel to each other along a length of the mount.

In a further embodiment of any of the foregoing embodiments, the bracket body is dimensioned to vertically space apart the first and second flanges such that a distance between the first and second flanges differs along a length of the mount.

In a further embodiment of any of the foregoing embodiments, the second flange slopes between opposed ends of the bracket body.

In a further embodiment of any of the foregoing embodiments, the flotation device is made of a polymer material.

A watercraft according to an example of the present disclosure includes a plurality of pontoons. Each of the pontoons define a pair of elongated slots extending between opposed ends of a main body. A frame mounted to a deck has a main body extending between forward and aft ends and extending between opposed sides. A plurality of elongated mounts are arranged in adjacent sets of mounts along respective ones of the pontoons. Each of the mounts has first and second flanges extending outwardly from a bracket body. The first flange is mechanically attached to the frame, and the second flange of each of the sets of mounts is slideably received in a respective one of the pair of slots to secure the pontoons to the frame.

In a further embodiment of any of the foregoing embodiments, the first and second flanges extend outwardly from the bracket body such that the respective mount has a generally S-shaped geometry.

In a further embodiment of any of the foregoing embodiments, the bracket body is dimensioned to vertically space apart the first and second flanges such that a distance between the first and second flanges differs along a length of the respective mount.

In a further embodiment of any of the foregoing embodiments, the second flange slopes between opposed ends of the bracket body such that opposed ends of a respective one of the pontoons are situated at different elevations relative to the frame.

In a further embodiment of any of the foregoing embodiments, each of the mounts extends at least partially between the forward and aft ends of the frame.

In a further embodiment of any of the foregoing embodiments, each one of the pontoons is made of a polymer material.

In a further embodiment of any of the foregoing embodiments, the plurality of pontoons include a first pontoon arranged between second and third pontoons.

In a further embodiment of any of the foregoing embodiments, the sets of mounts include first, second and third sets of mounts that secure respective ones of the first, second and third pontoons. Each mount of the first set of mounts is dimensioned to establish a first elevation relative to a bottom of the frame. Each mount of the second and third sets of mounts is dimensioned to establish a second elevation relative to the bottom of the frame. The first elevation is greater than the second elevation.

A further embodiment of any of the foregoing embodiments includes an engine mount mechanically attached to the frame, wherein the engine mount is configured to mount an engine.

In a further embodiment of any of the foregoing embodiments first and second end brackets are mechanically attached to forward and aft ends of respective ones of the sets of mounts to secure the adjacent sets of mounts in respective ones of the pair of slots.

A method of assembly for a watercraft according to an example of the present disclosure includes attaching an opposed pair of elongated mounts to a frame, each one of the mounts has a flange extending outwardly from a bracket body, and slideably receiving the flange in a respective elongated slot defined in a pontoon to secure the pontoon to the frame.

In a further embodiment of any of the foregoing embodiments, the pontoon is made of a polymer material.

In a further embodiment of any of the foregoing embodiments, the mount has a generally S-shaped geometry.

In a further embodiment of any of the foregoing embodiments, the bracket body is dimensioned to vertically space apart the flange from the frame such that the flange slopes between opposed ends of the bracket body.

The various features and advantages of this disclosure will become apparent to those skilled in the art from the following detailed description. The drawings that accompany the detailed description can be briefly described as follows.

DETAILED DESCRIPTION

Figure 1:
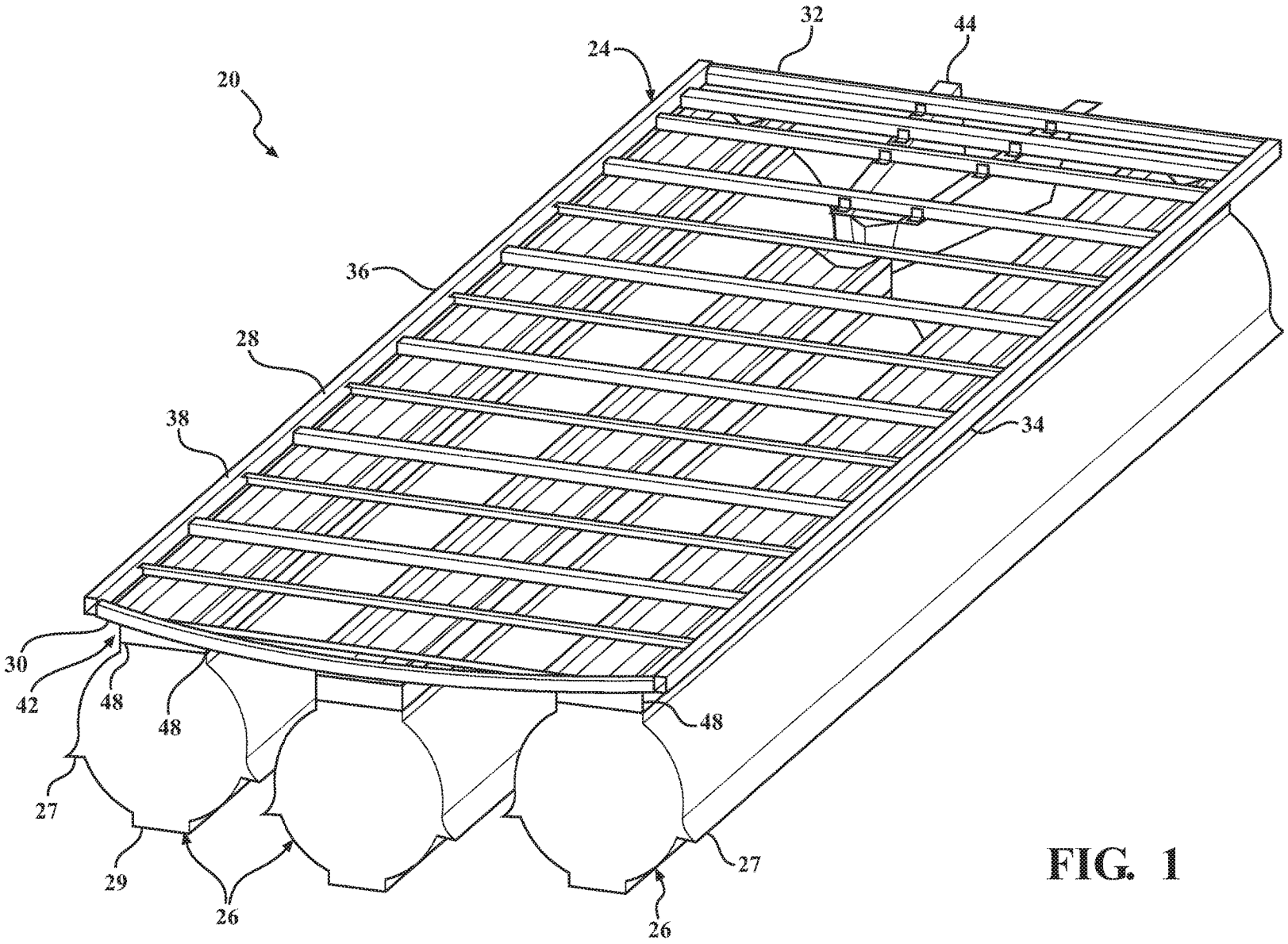
FIG. 1 illustrates a perspective view of a watercraft.

The present disclosure relates to exemplary mounting arrangements and other features of a watercraft. Although the disclosure primarily refers to a pontoon or pontoon boat, other watercraft and vehicles can benefit from the teachings herein. In this disclosure, like reference numerals designate like elements where appropriate and reference numerals with the addition of one-hundred or multiples thereof designate modified elements that are understood to incorporate the same features and benefits of the corresponding original elements.

FIG. 1-7 illustrates a watercraft 20 according to an example. In the illustrated example, the watercraft 20 is a pontoon boat. The watercraft 20 includes a frame 24 and one or more pontoons or flotation devices 26. The frame 24 includes a main body 28 that extends axially between a forward end (i.e., bow) 30 and an aft end (i.e., stern) 32, and extends between opposed left and right sides (i.e., port and starboard) 34, 36. The frame 24 can be made of metal or metal alloy, for example, to provide rigidity. The frame 24 establishes a support 38 for mounting a deck 40 (shown in dashed lines in FIG. 3).

Figure 2:
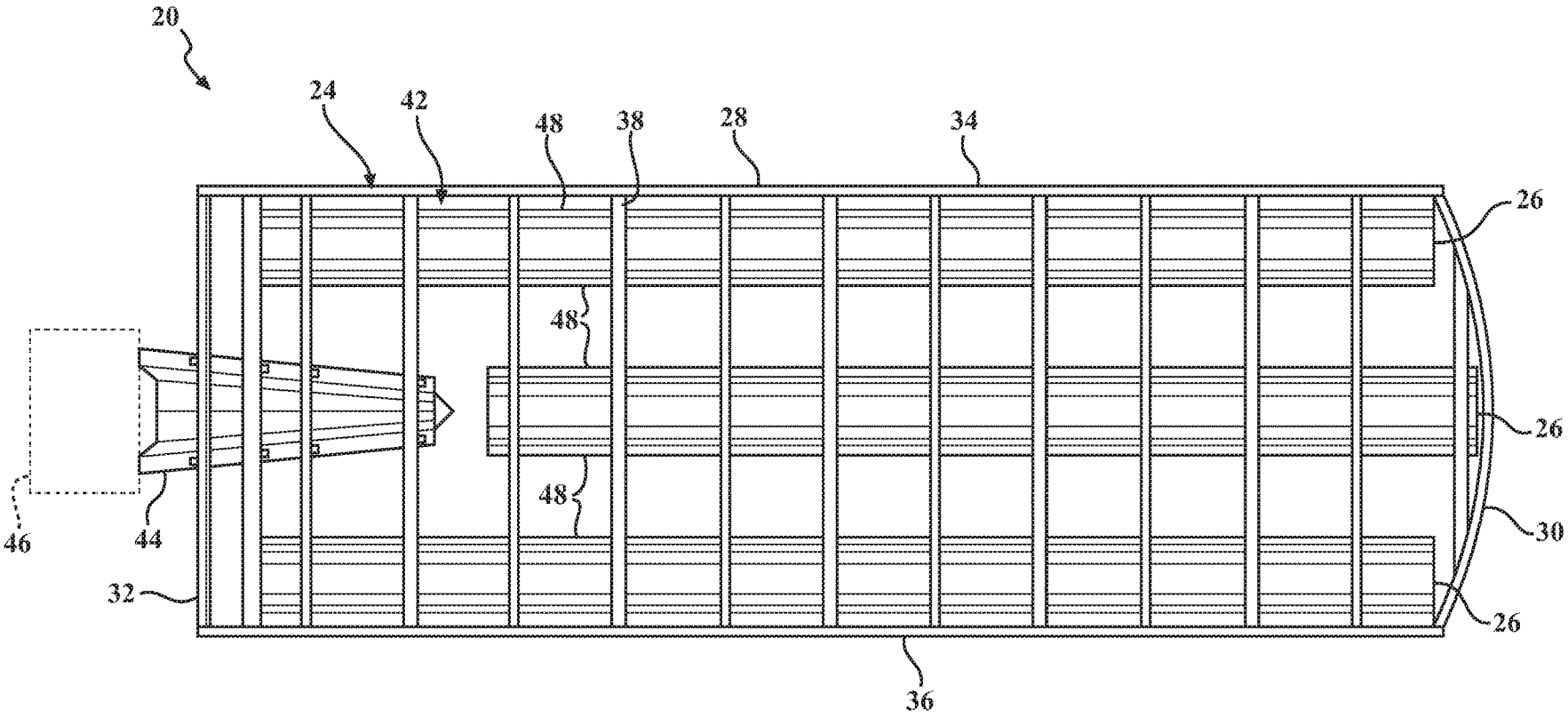
FIG. 2 illustrates a plan view of the watercraft of FIG. 1.
Figure 3:
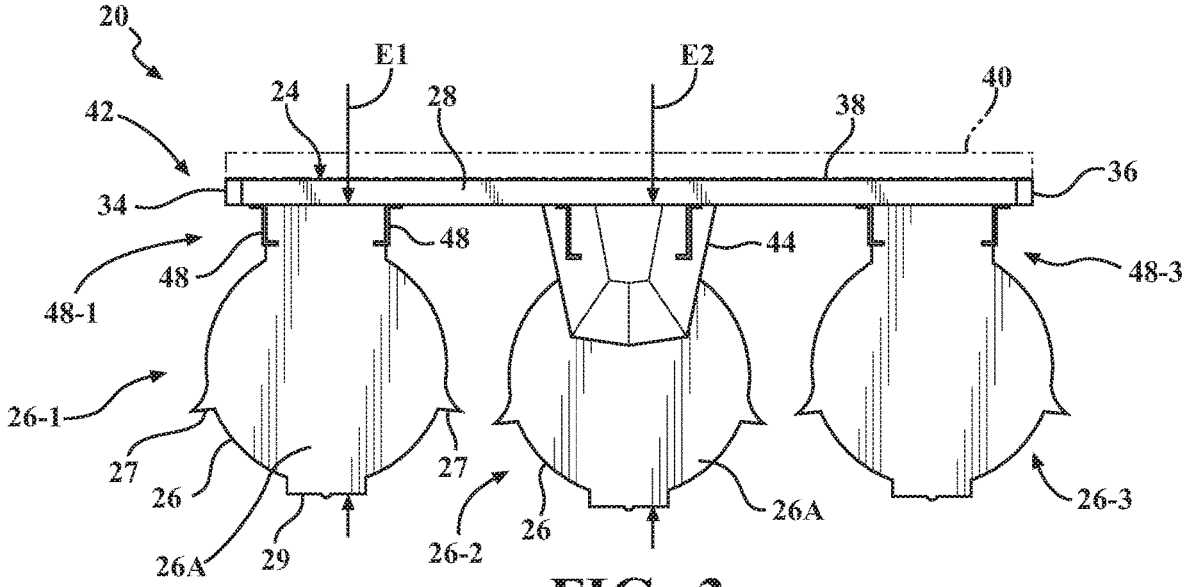
FIG. 3 illustrates a front view of the watercraft of FIG. 1.

In the illustrated example of FIGS. 1-3 and 6-7, each flotation device 26 is an elongated tube including a hollow interior to provide buoyancy in water during operation of the watercraft 20. Referring to FIGS. 1-3, the flotation device 26 can be made of a metal, metal alloy or a synthetic material such as a polymer (e.g., "polytube"), for example. In the illustrated example of FIGS. 1-3, the watercraft 20 includes three flotation devices 26 mounted to the frame 24. However, the watercraft 20 can include fewer or more than three flotation devices 26 to provide buoyancy, such as only two flotation devices 26.

A cross section of the flotation device 26 can have a generally elliptical geometry, as illustrated by FIG. 3. One or more features 27, 29 can be defined along a circumference of the flotation device 26 to establish an interaction with the surrounding fluid during operation, which can improve maneuverability and stability of the watercraft 20.

The watercraft 20 includes a mounting assembly 42 that mechanically attaches or otherwise fixedly secures the flotation devices 26 to the frame 24. The mounting assembly 42 includes a motor mount 44 mechanically attached to and extending from the aft end 30 of the frame 24 to mount an engine 46 (shown in dashed lines in FIG. 2) for propulsion.

Referring to FIGS. 3-6, with continuing reference to FIGS. 1-2, the mounting assembly 42 includes a plurality of elongated brackets or mounts 48 mechanically attached to and extending downwardly from the frame 24. Each of the mounts 48 can be elongated to span at least partially between the forward and aft ends 30, 32 of the frame 24. Each mount 48 can be made of a metal or metal alloy, for example, and can be shaped to a predetermined geometry. Each mount 48 can be mechanically attached to the frame 24 by welding or with one or more fasteners, for example.

Figure 4:
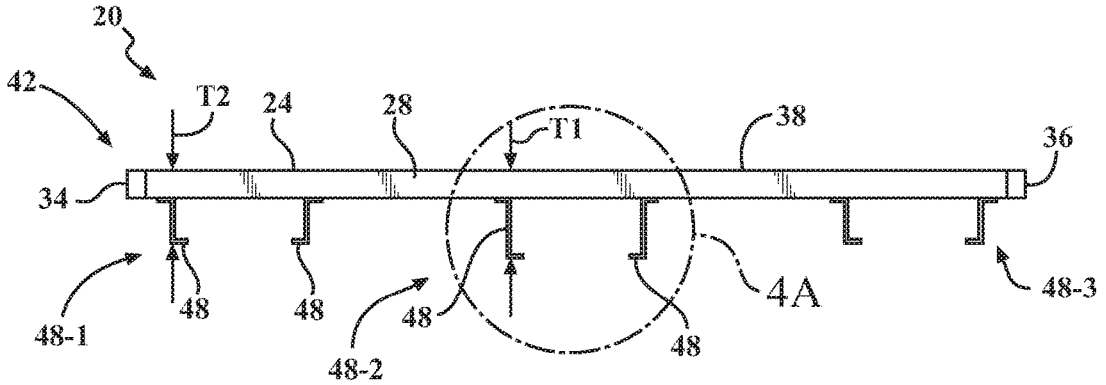
FIG. 4 illustrates a mounting assembly for the watercraft of FIG. 1.
Figure 4A:
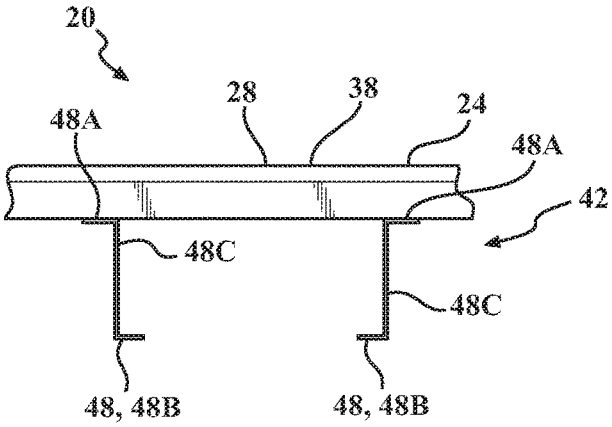
FIG. 4A illustrates selected portions of the mounting assembly of FIG. 4 along sectional line 4A-4A.
Figure 4B:
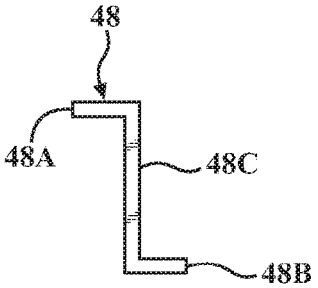
FIG. 4B illustrates an isolated view of a bracket.
Figure 5:
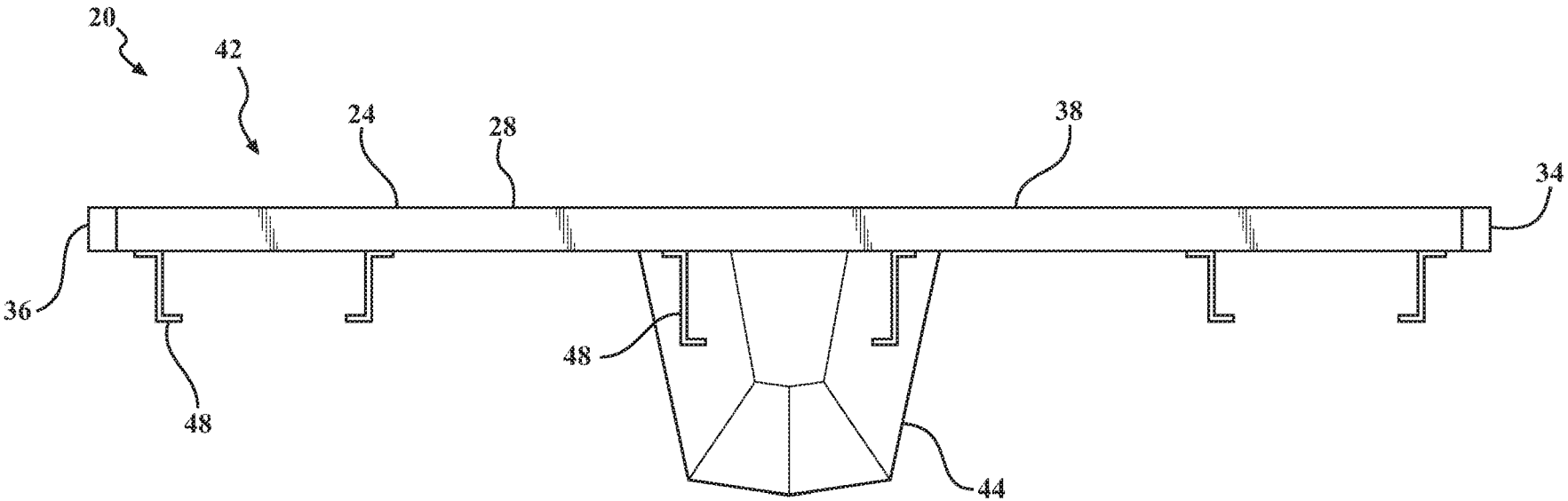
FIG. 5 illustrates the mounting assembly for the watercraft of FIG. 1 including an engine mount.

As illustrated in FIG. 4B, each bracket 48 can have a generally S-shaped geometry including first and second flanges 48A, 48B extending outwardly from a bracket body 48C. The bracket body 48C can be dimensioned such that first and second flanges 48A, 48B are vertically spaced apart and extend substantially parallel to each other along a length of the bracket 48 to situate each flotation device 26 at a substantially constant elevation relative to the frame 24.

Figure 6:
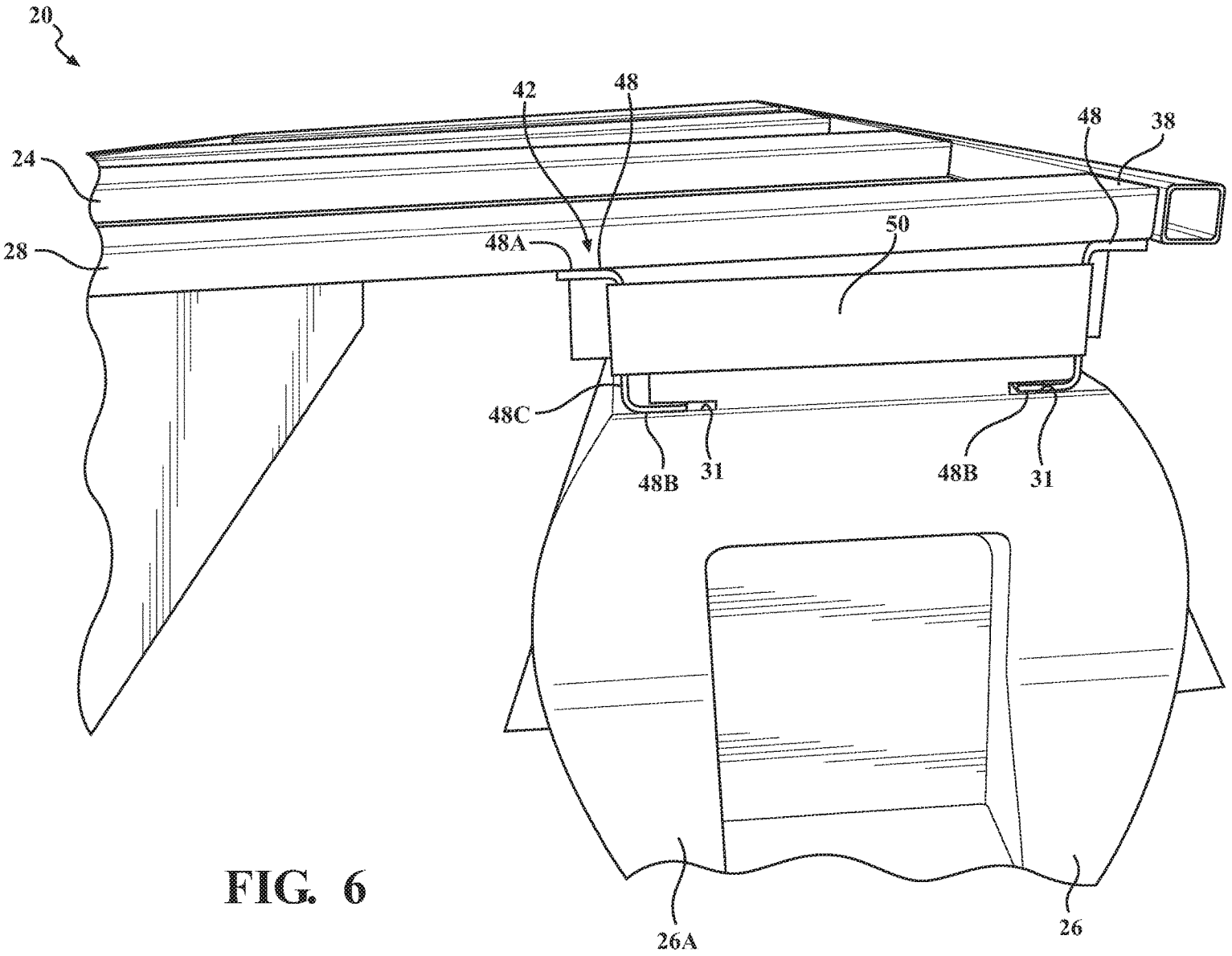
FIG. 6 illustrates a perspective view of the mounting assembly of FIG. 4 mounting a flotation device.
Figure 7:
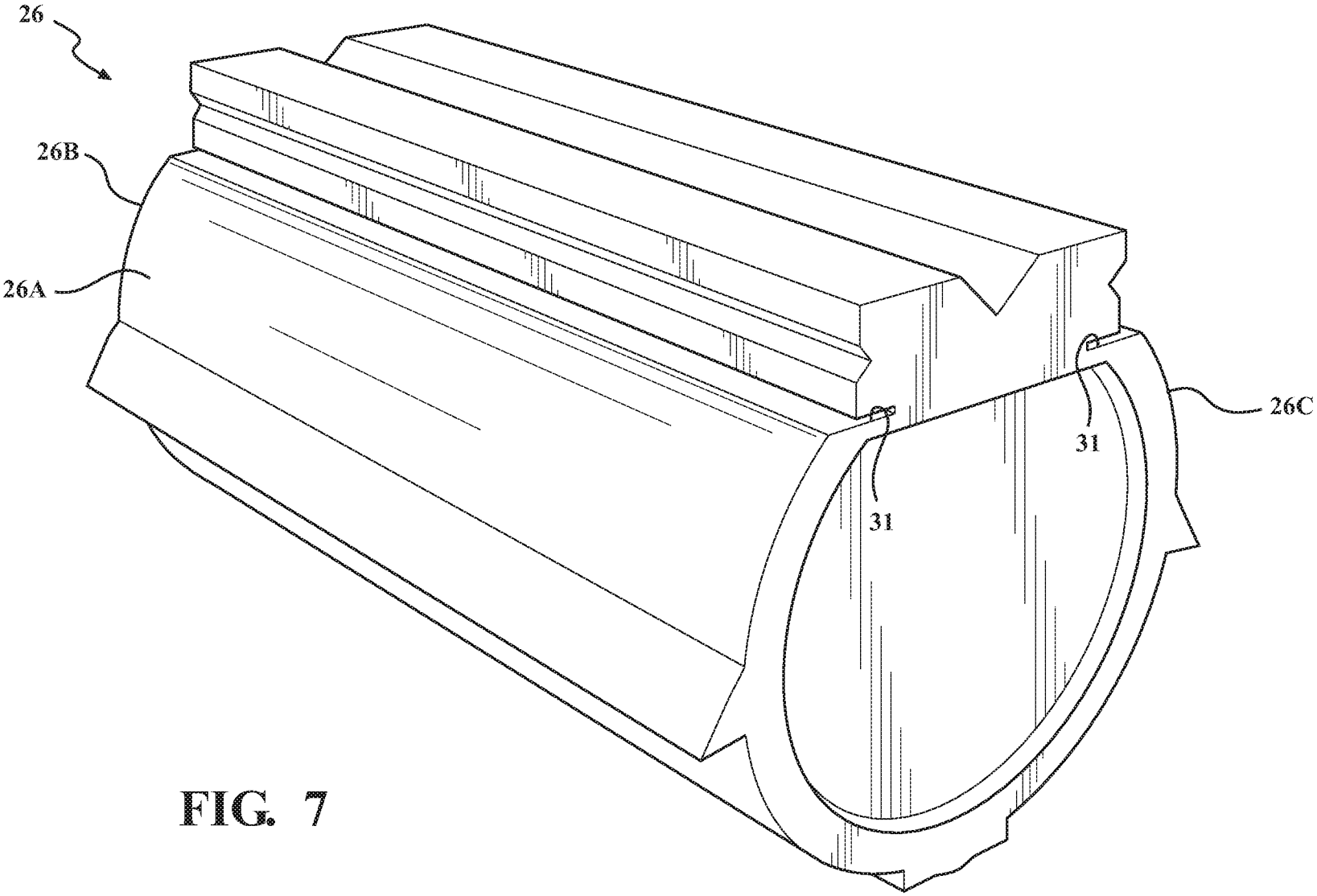
FIG. 7 illustrates an isolated perspective view of the flotation device of FIG. 6.

The first flange 48A is mechanically attached to the frame 24. The second flange 48B is mechanically attached or otherwise secured to the respective flotation device 26. In the illustrated example of FIGS. 6 and 7, the second flange 48B is secured in an elongated groove or slot 31 defined by a main body 26A (see also FIG. 3) of a respective one of the flotation devices 26. The slot 31 can extend between opposed ends 26B, 26C of the flotation device 26, as illustrated by FIG. 7. Each flotation device 26 defines a pair of elongated slots 31 extending between opposed ends of the main body 26A, each of the slots 31 dimensioned to receive a respective one of the second flanges 48B to secure the respective flotation device 26, as illustrated by FIG. 6 (see also FIG. 3). The second flange 48B can be slideably received in the slot 31 to secure the flotation device 26 to the frame 24. An end bracket 50 (FIG. 6) can be mechanically attached to forward and aft ends of a pair of adjacent brackets 48 to secure the flotation device 26 to the frame 24 subsequent to the flotation device 26 slideably receiving each pair of the second flanges 48B in the slots 31. The slots 31 can improve the ability of the flotation devices 26 to expand and contract due to variation in thermal loading, which can reduce stress on the flotation devices 26 and respective mounts or brackets 48.

Each pair of brackets 48 can be spaced apart from each other and can be dimensioned to situate a respective one of the flotation devices 26 at a predetermined elevation. In the illustrated example of FIG. 4, the mounting assembly 42 includes first, second and third sets of brackets 48-1, 48-2 and 48-3. Each of the second set of brackets 48-2 is dimensioned to establish a distance T1, and each of the first and third sets of brackets 48-1, 48-3 is dimensioned to establish a distance T2. As illustrated by FIG. 3, respective first, second, and third flotation devices 26-1, 26-2 and 26-3 are situated relative to a bottom of the frame 24. The first and third flotation devices 26-1, 26-3 each establish an elevation E1, and the second flotation device 26-2 establishes an elevation E2. The elevations E1, E2 can be the same or can differ. In the illustrate example of FIG. 3, the sets of brackets 48-1, 48-2 and 48-3 are dimensioned such that elevation E2 is greater than elevation E1.

Figure 8:
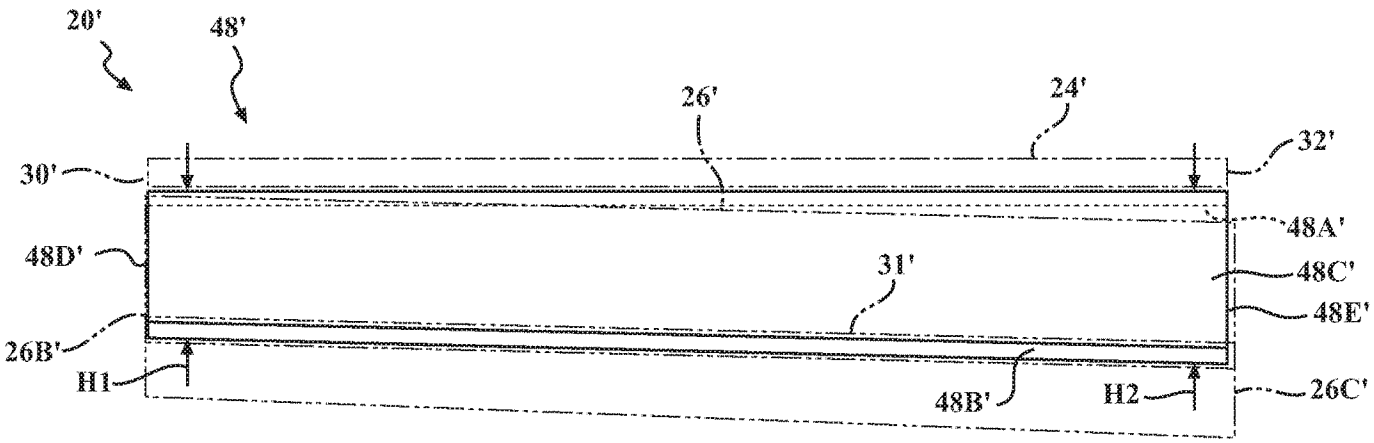
FIG. 8 illustrates a bracket of a mounting assembly according to an example.

As illustrated by FIG. 8, bracket body 48C' can be dimensioned such that a distance between first and second flanges 48A', 48B' differs along a length of bracket 48', as illustrated by heights H1, H2. The second flange 48B' slopes between opposed ends 48D', 48E' of the bracket body 48C'. The second height H2 is greater than the first height H1, and can be defined adjacent to an aft end 32' of frame 24' (shown in dashed lines). The different heights H1, H2 cause the opposed ends of the respective flotation device 26' (shown in dashed lines for illustrative purposes) to be situated at different elevations relative to the frame 24' to skew the elevation of the watercraft 20' in the water between the forward and aft ends 30', 32'. The relatively greater height H2 can increase buoyancy at an aft end 30' of the watercraft 20'.

Figure 10:
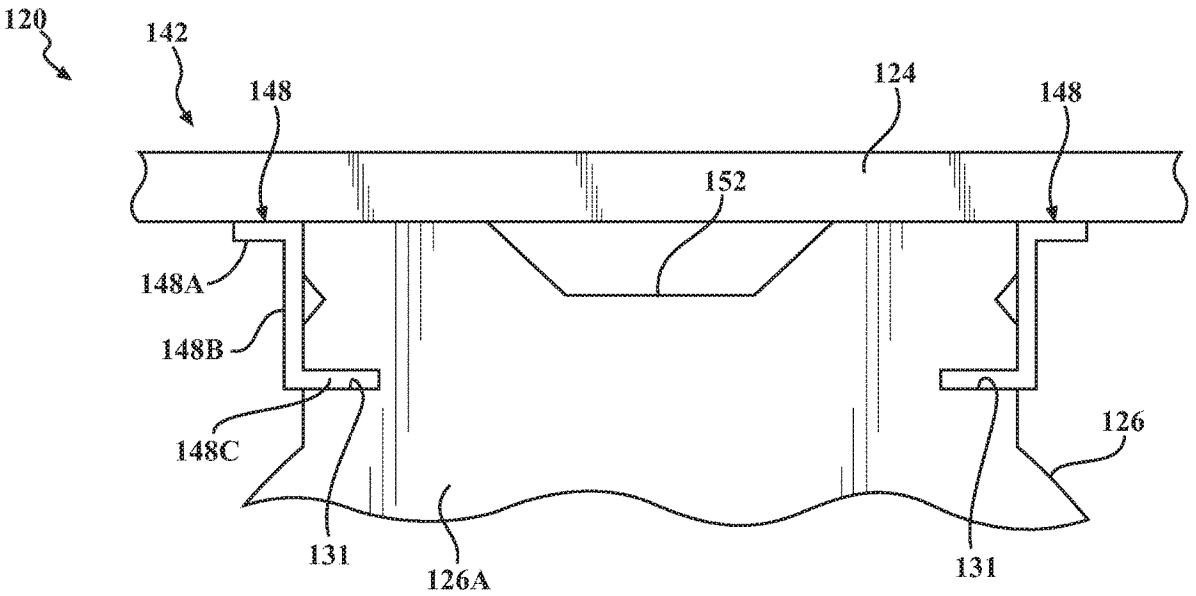
FIG. 10 illustrates a mounting assembly for the watercraft of FIG. 9.
Figure 9:
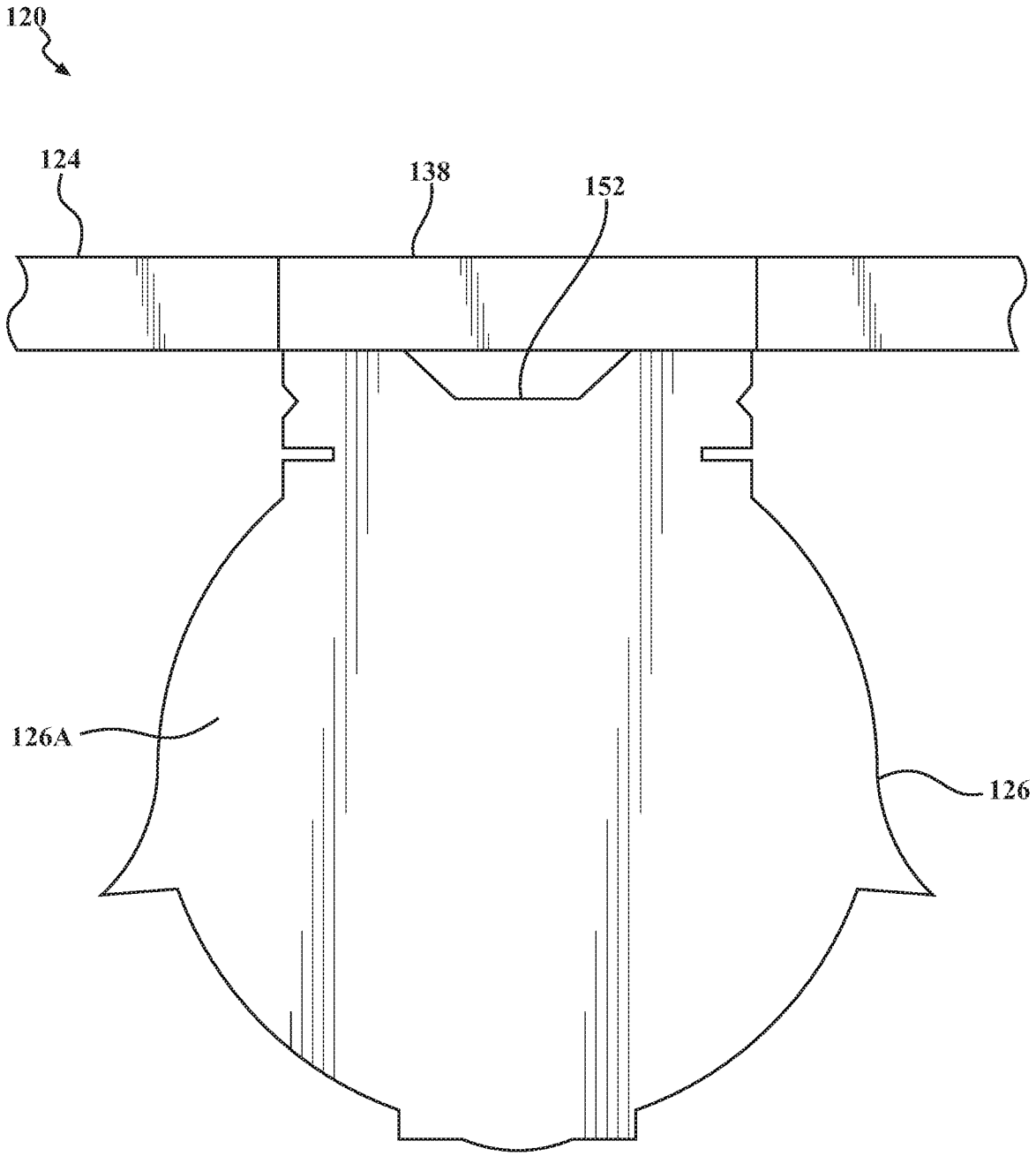
FIG. 9 illustrates a sectional view of a watercraft according to another example.

FIGS. 9 and 10 illustrate a watercraft 120 according to another example. FIG. 9 illustrates flotation device 126 adjacent frame 124. FIG. 10 illustrates mounting assembly 142 including a pair of opposed brackets 148. Second flanges 148C are received in respective slots 131 defined by the flotation device 126. The flotation device 126 can define an elongated trough 152 that establishes a cavity between surfaces of the frame 124 and the flotation device 126. The trough 152 can extend between opposed ends of the flotation device 126 to receive one or more cables or conduits, for example.

It should be understood that relative positional terms such as "forward," "aft," "upper," "lower," "above," "below," and the like are with reference to the normal operational attitude of the vehicle and should not be considered otherwise limiting.

Although the different examples have the specific components shown in the illustrations, embodiments of this disclosure are not limited to those particular combinations. It is possible to use some of the components or features from one of the examples in combination with features or components from another one of the examples.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. An assembly for a watercraft comprising:

a flotation device including a main body extending axially between opposed ends, the flotation device including at least one elongated slot extending inwardly from a peripheral wall of the main body such that the at least one elongated slot extends along a length of the main body between the opposed ends; and at least one elongated mount including first and second flanges extending outwardly from a bracket body, the first flange configured to be mechanically attached to a frame, and the second flange slideably received in the at least one elongated slot to secure the flotation device.

2. The assembly as recited in claim 1, wherein the bracket body is dimensioned such that the first and second flanges are vertically spaced apart from each other along a length of the at least one mount.

3. The assembly as recited in claim 2, wherein the first and second flanges extending outwardly from opposed sides of the bracket body such that the at least one mount has a generally S-shaped geometry.

4. The assembly as recited in claim 2, wherein the bracket body is dimensioned such that a distance between the first and second flanges differs along a length of the at least one mount.

5. The assembly as recited in claim 1, wherein the main body includes a flotation portion and an interface portion extending outwardly from the flotation portion, and the at least one elongated slot is established between the flotation portion and the interface portion.

6. The assembly as recited in claim 5, wherein the at least one elongated slot includes a pair of elongated slots on opposed sides of the interface portion.

7. The assembly as recited in claim 6, wherein the flotation device includes a pair of lifting strakes extending outwardly from a circumference of the main body, each of the lifting strakes tapering from the circumference of the main body to a respective apex, the flotation device includes a pad portion extending outwardly from the circumference of the main body between the opposed ends, and the pad portion is established circumferentially between the pair of lifting strakes.

8. The assembly as recited in claim 6, wherein the flotation device is made of a polymer material.

9. The assembly as recited in claim 6, wherein the bracket body is dimensioned such that the first and second flanges are vertically spaced apart from each other along a length of the at least one mount, and the first and second flanges extend outwardly from opposed sides of the bracket body such that the at least one mount has a generally S-shaped geometry.

10. The assembly as recited in claim 9, wherein the bracket body is dimensioned such that a distance between the first and second flanges differs along the length of the at least one mount.

11. A watercraft comprising:

a plurality of pontoons, each of the pontoons including a main body extending axially between opposed ends and including a pair of elongated slots extending inwardly from opposed peripheral walls of the main body;

a frame mounted to a deck, the frame including a frame body extending between forward and aft ends and extending between opposed sides;

a plurality of elongated mounts arranged in adjacent sets of mounts along respective ones of the pontoons; and wherein each of the mounts includes first and second flanges extending outwardly from a bracket body, the first flange mechanically is attached to the frame, and the second flange of each of the sets of mounts is slideably received in a respective one of the pair of slots to secure the pontoons to the frame.

12. The watercraft as recited in claim 11, wherein the first and second flanges extend outwardly from opposed sides of the bracket body such that the respective mount has a generally S-shaped geometry.

13. The watercraft as recited in claim 11, wherein the bracket body is dimensioned such that a distance between the first and second flanges differs along a length of the respective mount.

14. The watercraft as recited in claim 11, wherein the main body of each of the pontoons includes a flotation portion and an interface portion extending outwardly from the flotation portion, and interface portion is positioned between the flotation portion and the frame in an installed position.

15. The assembly as recited in claim 14, wherein each of the pontoons includes a plurality of protruding members extending outwardly from a circumference of the main body, the flotation device includes a pad portion extending outwardly from the circumference of the main body between the opposed ends, and the pad portion is established circumferentially between the plurality of protruding members.

16. The watercraft as recited in claim 14, wherein each one of the pontoons is made of a polymer material.

17. The watercraft as recited in claim 16, wherein the plurality of pontoons include a first pontoon arranged laterally between second and third pontoons with respect to a width of the frame.

18. A method of assembly for a watercraft comprising:

attaching an opposed pair of elongated mounts to a frame, each one of the mounts including a flange extending outwardly from a bracket body; and slideably receiving the flange in a respective elongated slot defined in a peripheral wall of a pontoon to secure the pontoon to the frame.

19. The method as recited in claim 18, wherein the pontoon is made of a polymer material.

20. The method as recited in claim 18, wherein the bracket body is dimensioned such that a first distance between the frame and a first end of the slot differs from a second distance between the frame and a second end of the slot.

21. The assembly as recited in claim 7, wherein the flotation device includes a ridge extending outwardly from an outer surface of the pad portion, the ridge is spaced apart from a pair of sidewalls of the pad portion, and the pair of sidewalls interconnect the outer surface and the circumference of the main body.

* * * * *